US006209755B1

(12) United States Patent
Mühlbauer

(10) Patent No.: US 6,209,755 B1
(45) Date of Patent: Apr. 3, 2001

(54) DEVICE FOR SQUEEZING FLOWABLE MATERIAL OUT OF A TUBULAR BAG

(75) Inventor: Ernst Mühlbauer, Hamburg (DE)

(73) Assignee: Wolfgang Muhlbauer, Hamburg (DE)

( * ) Notice: Subject to any disclaimer, the term of this patent is extended or adjusted under 35 U.S.C. 154(b) by 0 days.

(21) Appl. No.: 09/242,121

(22) PCT Filed: Aug. 8, 1997

(86) PCT No.: PCT/EP97/04337

§ 371 Date: Feb. 10, 1999

§ 102(e) Date: Feb. 10, 1999

(87) PCT Pub. No.: WO98/06505

PCT Pub. Date: Feb. 19, 1998

(30) Foreign Application Priority Data

| | | |
|---|---|---|
| Aug. 12, 1996 | (DE) | 296 13 945 U |
| Oct. 10, 1996 | (DE) | 296 17 654 U |
| Apr. 29, 1997 | (DE) | 297 07 761 U |
| May 28, 1997 | (DE) | 297 09 408 U |

(51) Int. Cl.[7] ..... B65D 35/36
(52) U.S. Cl. ..... 222/105; 222/326
(58) Field of Search ..... 222/105, 94, 95; 422/325, 326

(56) References Cited

U.S. PATENT DOCUMENTS

| | | | | |
|---|---|---|---|---|
| 4,098,434 | * | 7/1978 | Uhlig | 222/105 |
| 5,407,093 | | 4/1995 | McGill | 220/666 |

FOREIGN PATENT DOCUMENTS

| | | | | |
|---|---|---|---|---|
| 0541972 | * | 1/1991 | (DE) | 222/105 |
| 1161905 | * | 11/1956 | (FR) | 222/105 |
| 2301306 | | 9/1996 | (FR) . | |
| WO 9215501 | | 9/1992 | (WO) . | |

* cited by examiner

*Primary Examiner*—Kevin Shaver
*Assistant Examiner*—Thach H Bui
(74) *Attorney, Agent, or Firm*—Alix, Yale & Ristas, LLP

(57) ABSTRACT

The inventive device for squeezing out flowable material includes an elongate tubular bag (1) containing the material, as well as an ejection device (2, 5) which has a cylindrical chamber (10) with a plunger (5) located therein and an outflow opening (9) to insert the bag therein. The bag has an opening (8) at one end surrounded by the bag (1) shoulder (12) and the sealing washer (13). For improved sealing, the sealing member (15, 17, 19, 22, 25) engages the chamber fore-part (11) surrounding the outflow opening (9). Additional parts may be provided to maintain said sealing member on the fore-part.

12 Claims, 2 Drawing Sheets

DEVICE FOR SQUEEZING FLOWABLE MATERIAL OUT OF A TUBULAR BAG

CROSS-REFERENCE TO RELATED APPLICATION

This is the national stage of International Application No. PCT/EP97/04337 filed Aug. 8, 1997.

BACKGROUND OF THE INVENTION

It is known to squeeze a flowable, pasty mass such as sealing mass or dental impression mass out of a tubular bag in that the latter is introduced into a cylindrical space which is acted upon from one end by a plunger and has a discharge opening or ejection nozzle at the other end, at which the bag has been opened. In this case, particular value is placed upon the sealing of that end of the tubular bag which contains the bag opening in relation to that end of the cylindrical space which forms the discharge opening and the ejection nozzle. If, for this purpose, the tubular bag is fixedly connected to the unit forming the cylindrical space (FR-A 1 161 905), the multiple use of the squeezing-out unit for a plurality of tubular bags is made impossible. To avoid this disadvantage, an arrangement for squeezing out from exchangeable tubular bags has become known (EP-A 541 972), in which arrangement the gathered end of the tubular bag, which end forms the bag opening, is fixedly connected to a sealing ring which has a conical sealing surface which cooperates with a corresponding conical sealing surface in the discharge opening of the squeezing-out unit. Under the action of the squeezing-out plunger, the cone of the sealing ring is pressed into the conical discharge opening, provided that it has been adequately centred in advance. If the centring is inadequate, no sealing takes place. If the cone of the sealing ring sits precisely centrally in the discharge opening, it appears to be possible to achieve an adequate sealing action as long as the action of the plunger force persists. However, this sealing action ends when, upon termination of the plunger force, the arrangement "breathes". Since, during squeezing out, the greatest part of the pressure drop does not occur in the bag opening or the discharge opening of the squeezing-out unit, but in the downstream spaces of the nozzle and of the possibly present mixing device, a considerable pressure builds up, during squeezing out, in these spaces downstream of the discharge opening, which pressures leads to corresponding expansion of the associated wallings. When the squeezing-out force of the plunger ends, this expansion then leads to a back pressure and a back flow of the mass in the region of the discharge opening. As a result of this, the cone of the sealing ring may be lifted off from its conical seat in the discharge opening; the sealed gap opens and the mass can penetrate into the space to be sealed off between sealing ring and tubular bag on the one hand and cylindrical space on the other hand. Furthermore, the mutual centering may be lost, so that the cone of the sealing ring is not passed back into the correct seat upon the next application of pressure. Accordingly, contamination of the unit cannot be entirely avoided by the known arrangement. In addition, there is the disadvantage that in the case of the exchange of the tubular bag the discharge opening must be carefully cleaned, because otherwise residues of the mass which have remained there and possibly solidified make a complete sealing off impossible, even during the action of the squeezing-out force; this then leads to further contamination of the unit. Furthermore, the known mode of sealing off requires careful production and assembly of the parts participating in the sealing off; this being costly. In another known arrangement for squeezing out from exchangeable tubular bags (FR-A 2 301 306, FIG. 4), a flat sealing ring is inserted between the flat end of the bag, which is provided with a cross-shaped incision for forming a squeezing-out opening, and the end face of the cylinder space, surrounding the discharge opening. This sealing ring is not connected to thy end of the bag. It has therefore been found that it cannot ensure a tight seal in the region of folds in the bag.

SUMMARY OF THE INVENTION

The object of the invention is to provide an arrangement for squeezing a free-flowing substance out of an elongated tubular bag which is less expensive, permits an easy exchange of the tubular bag, and nevertheless ensures adequate sealing.

The invention is based on the observation that leakage is often caused by the sealing ring being slightly oblique with respect to the axis of the bag, for example if the bag has been distorted as a result of deformation due to unskilled handling upon insertion into the cartridge. The invention avoids this effect by the sealing ring being connected to the bag in an angularly movable fashion, so that it can align itself with the associated counter sealing surface. This angular mobility is brought about by connecting the sealing ring to a disk or designing it as a disk which is adhesively bonded to the end face of the bag within an annular bead facing the latter and of a diameter which is substantially less than that of the bag. In this case, the disk region outside the annular bead remains free from the connection to the end face of the bag and can therefore move towards it on one side and away from it on the other side, the annular bead forming a kind of tilting bearing.

The capability of the sealing ring to align itself with the end face surrounding the discharge opening produces a reliable sealing-off effect. A cleaning of the end face cooperating with the sealing components is frequently unnecessary, because experience shows that the mass seldom advances to such an extent. Moreover, the cleaning of this surface is easier than that of the discharge opening, because it is more readily accessible and can be monitored more easily. The cooperating sealing surfaces place less stringent requirements on precise production and assembly, because it is not necessary to coordinate any diameters whatsoever accurately with one another. Finally, the invention has the advantage that the sealing off is independent of the respective design of the discharge opening and the tubular bags can accordingly be used in differing squeezing-out units.

In general, the end face surrounding the discharge opening of the squeezing-out unit is flat. In these circumstances, it is recommended also to design the sealing ring (possibly apart from projecting sealing components) to be flat, so that it can extend parallel to the end face. This applies in particular in circumstances in which, according to a further feature of the invention, it has an external diameter which is approximately equal to, or only slightly smaller than, the diameter of the cylindrical space. The result of this is a good guiding and centering of the end of the tubular bag upon introduction into the ejection opening.

It is known to have the bag opening formed by a gathering of the bag, which gathering penetrates through the sealing ring and is cut away. According to the invention, this gathering lies freely in the discharge opening. Thereby, it is achieved that, under the action of the squeezing-out differential pressure, the gathering is applied to a greater or lesser extent to the walling of the discharge opening and there forms a sealing off upstream of the sealing ring. Even where such sealing off may not be complete, it does nevertheless obstruct the passage of the mass, so that frequently the latter does not actually reach the sealing components of the sealing ring.

The sealing component or the sealing components of the sealing ring are pressed, by the squeezing-out force exerted by the plunger on the tubular bag, against the end face of the cylindrical space and are able thereby to perform their sealing action during the squeezing-out process. They can be designed in various ways, in accordance with the known principles of sealing technology. In the simplest case, the substantially flat surface of the sealing ring or the latter itself forms the sealing component. However, it is also possible to provide particular sealing components, projecting from its surface, in any desired number. Expediently, they are designed in yielding fashion, so that they can adapt in gap-free fashion to the counter sealing surface formed by the end face. The requirements imposed upon the accuracy of production are thereby further curtailed. This applies to any form of the sealing component or of the sealing components, namely both in the case of large area contact of the sealing ring designed in disk fashion with the end face and also in circumstances in which the sealing component is designed as annular projection. It may have, for example, the form of one or more circulating, thin sealing lips. The softness is then given by the thinness of the sealing lip. In the case of another design, the sealing ring is provided with an additional, circulating soft material ring, for example a commercially available O-ring or a ring of foam rubber having a closed surface. Such an additional annular part can also be a part which is separate from the sealing ring and which abuts tightly thereagainst. This design has the advantage that the part of the sealing ring which is designed together with the tubular bag as a throw-away part can be designed in a particularly low cost fashion, while the additional annular part, which has or forms the sealing component, can be repeatedly used and can accordingly be formed in a correspondingly more costly fashion.

In order to avoid the lifting off of the sealing components from the end face of the cylindrical space, according to a further feature of the invention the sealing ring can be provided with a retaining part arresting it in the sealing position. The invention prefers two embodiments of this concept.

In the case of the first embodiment of the retaining part, the disk is equipped with a suction holder holding it fast at the end face. This may comprise one or more suction cups. Expediently, the sealing component is designed as a suction holder. This is the case in circumstances in which a first, inner sealing ring and a second, outer sealing ring enclose with the end face a space, the volume of which decreases as a result of the compression of the sealing rings against resilient deformation of the same, the compressed air between the sealing rings and the end face is expelled and, upon cessation of the plunger force, cannot return into the intermediate space without further ado, by reason of the sealing action of the sealing rings. In this case, the sealing rings are expediently designed as sealing lips, which point outwards from the suction space, in order to facilitate the exit of the air from the suction space, but to impede the re-entry of the air.

According to the second embodiment, a braking component is provided at the end of the bag opposite the end of the bag containing the opening. This generally requires the bag to be pushed into the cylinder space from the end remote from the discharge opening. The braking component disposed at the rear end of the tubular bag holds the bag firmly in the respective position in the cylindrical space. By means of friction, it also prevents a situation in which in the course of the removal and vertical erection of the cylinder with the outlet opening upwards, the bag slips backwards or even falls out of the cylinder. As a result of the fact that, upon insertion of the bag into the cylindrical space, the drawing-in force is exerted directly on the braking component disposed at the rear end of the tubular bag, it does not need to be transferred via the bag and its contents to the braking component, and accordingly has no effect on the internal pressure of the bag.

BRIEF DESCRIPTION OF THE DRAWINGS

In the text which follows, the invention is explained in greater detail with reference to the drawing, which illustrates advantageous illustrative embodiments. In the drawing.

DETAILED DESCRIPTION OF THE PREFERRED EMBODIMENT

Figure 1:
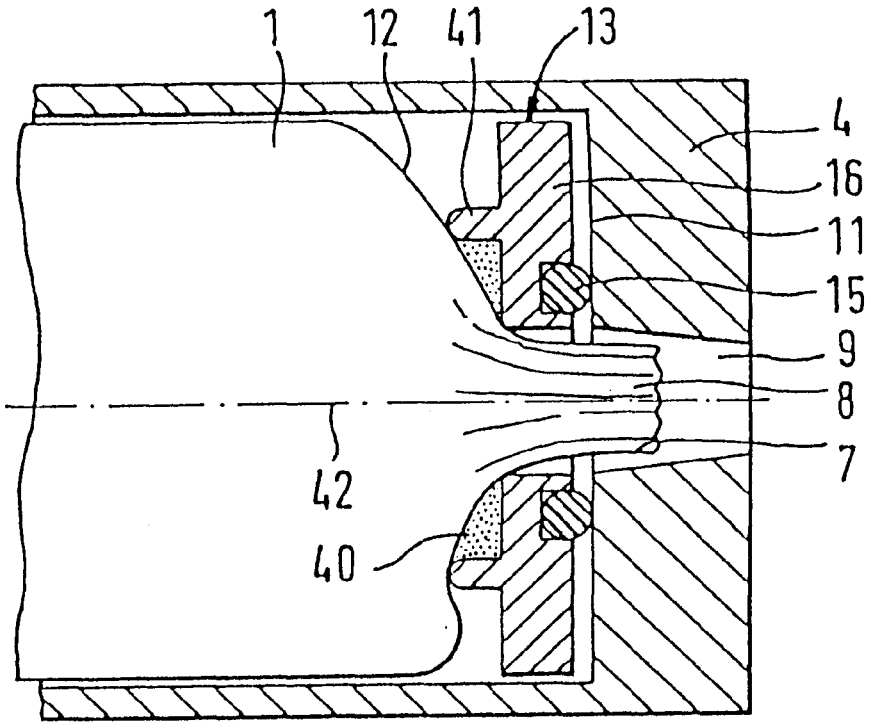
FIG. 1 shows an exemplary embodiment with a sealing ring fastened on the bag in an angularly movable fashion.

FIG. 1 shows the tubular bag 1 within a so-called cartridge 2, which comprises a wall 3 and a floor 4. Its internal diameter is dimensioned in such a manner as to fit that of the tubular bag 1. Cartridges of this type with tubular bags are used as exchangeable inserts in units for the expulsion of plastic masses, for example in units for the expulsion of dental multicomponent impression masses (EP-A 492 413). The cartridges are inserted into the unit in such a way that a plunger specific to the unit can penetrate into the open end, remote from the floor, of the cartridge, in order to squeeze out the tubular bag 1. The end 7, which is gathered together and which is closed in the storage condition, of the bag is cut away in such a way that a bag opening 8 is formed, which opens into a discharge opening 9 set in the floor 4 of the cartridge. A sealing ring 13 is inserted between that end face 11 of the floor 4 which faces the cylindrical space 10 of the cartridge and the shoulder surface 12 of the tubular bag 1. When the plunger compresses the tubular bag 1, the mass contained therein can flow through the bag opening 8 and the discharge opening 9 into the downstream spaces of the unit, which are not shown, in order for example to be mixed with another component and finally to be applied in the desired manner. The pressure generated by the plunger in the tubular bag 1 also acts, via the shoulder surface 12, on the sealing ring 13, so that the latter forms an effective sealing off between the end face 11 and the shoulder surface 12. Moreover, the gathering 7 is pressed against the wall surface of the discharge opening 9, so that an upstream sealing is created at this position. The concept cylindrical space is not intended to state that the wall 3 has to be cylindrical; however, it is expediently so.

In the event of inattentive insertion of the deformed bag 1 into the cylinder 3, it may happen that the end face of the bag is slightly distorted obliquely. The corresponding oblique position of the end face is transferred to the sealing ring if the latter is designed as a disk or is connected to a disk which is adhesively bonded in full surface fashion to the end face of the bag. Depending upon the design of the seal, the sealing action may suffer if the plane of the sealing ring does not stand precisely vertically to the cylinder axis. In order to deal with this risk, it is provided that the sealing ring 13 is connected to the bag 1 in angularly movable fashion in relation to the bag axis 42. As a consequence of this, it can align itself in accordance with its correct sealing position if it is pressed by the bag against the end face of the cartridge floor, even if the bag should be slightly distorted.

Figure 2:
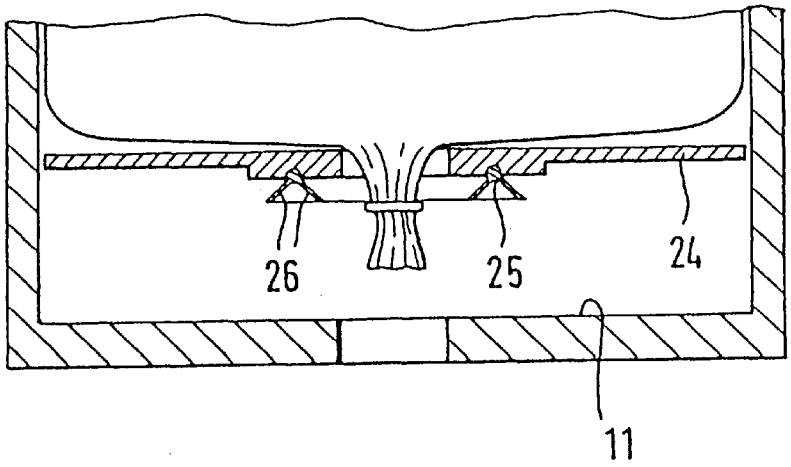

FIG. 1 reveals that the disk 16 of the sealing ring, which is designated as a whole by the reference numeral 13, is connected to the end face 12 of the bag 1 by means of an adhesive bonding and sealing mass 40. The connection is restricted to the radially inner region of the disk 16 and the end face 12 and is outwardly limited by a bead 41, which is provided in annular fashion on that end face of the disk 16 which faces the bag 1, concentrically to the disk opening and to the disk periphery. Outside the annular bead 41, the disk 16 and the bag end face 12 are unconnected and, as a rule, slightly lifted off from one another. The result of this is that the disk 16 can tilt freely in relation to the bag end face 12 within a certain angular range; in which case, the bead 41 is pressed on the one side more and on the other side less into the bag. Any possible oblique position of the bag, as is indicated in FIG. 2, is accordingly unable to have an effect on the position of the disk 16 and the sealing action of the O-ring 15.

In FIG. 1, it has been presupposed that the floor 4 of the cartridge is fixedly connected to its wall 3 and the tubular bag 1 is inserted into the cartridge from that side which is remote from the expulsion side. However, it is also possible that the floor 4 can be released from the wall 3 in cover fashion for the insertion of the tubular bag 1. The margin of the sealing ring 13 can be drawn up in a pot shape towards the side of the tubular bag 1, in order to enlarge the height (dimension in the axial direction) of the peripheral surface, whereby a tilting over of the disk-shaped sealing ring upon introduction into the cartridge is avoided.

The sealing ring is designed as an annular disk 14, which, just like the end face 11, is designed to be flat. Its external diameter is not substantially smaller than that of the cylindrical space 10. Upon introduction of the tubular bag into the cartridge, it can therefore serve for the centering of the bag opening with respect to the discharge opening. It consists of stiff plastic material, in order to be able to attend to this task. Expediently, it also has such great strength that it can guarantee the position which is approximately flat or parallel to the end face 11.

Close to the inner margin of the annular disk 14, an O-ring 15 (there may also be a plurality) is tightly and preferably fixedly connected to the annular disk 14, in that it is adhesively bonded into or clamped into an annular groove, for example. It consists of soft rubber or foam rubber having a closed surface and accordingly abuts, under the pressure acting during the squeezing-out process, in gap-free fashion against the end face 11 and thus forms an effective protection against the penetration of mass from the discharge opening 9, in the event that mass should pass through between the gathering 7 and the wall of the discharge opening 9. In principle, the arrangement according to the invention is exposed in just the same way as known arrangements, to the "breathing" of the device upon termination of the squeezing-out pressure. Since, however, the bag opening 8 can have a larger clear diameter than known tubular bags, by reason of the absence of an annular part penetrating into the discharge opening 9, its resistance to flow is small, so that the extent of the "breathing" and thus the risk of penetration of mass between the gathering 8 of the tubular bag and the wall of the discharge opening 9 are smaller than in the case of known arrangements.

The sealing component may assume different forms. It may, for example, be a layer of soft resilient material, for example foamed, resilient plastic material or rubber having an open or closed surface, cooperating over a large surface area with the end face 11. It may also be formed by one or more annular projections or resilient sealing lips which are sharp in cross section and integral with the disk 16.

If the sealing component is formed by a soft layer, it may be fixedly connected to the annular disk 16, for example formed by a coating provided thereon or adhesively bonded to it. However, it can also be a separate annular disk, which, if appropriate, can be used repeatedly. The sealing components can also be formed from a plurality of annular circulating annular projections, which are sharp in cross section and which are integral with the annular disk and which abut against the end face 11. The material is chosen and the sharpness of the annular projections is dimensioned in such a way that these can abut under the squeezing-out force, in gap-free fashion, against the end face 11 and in this way form an effective sealing.

Figure 3:
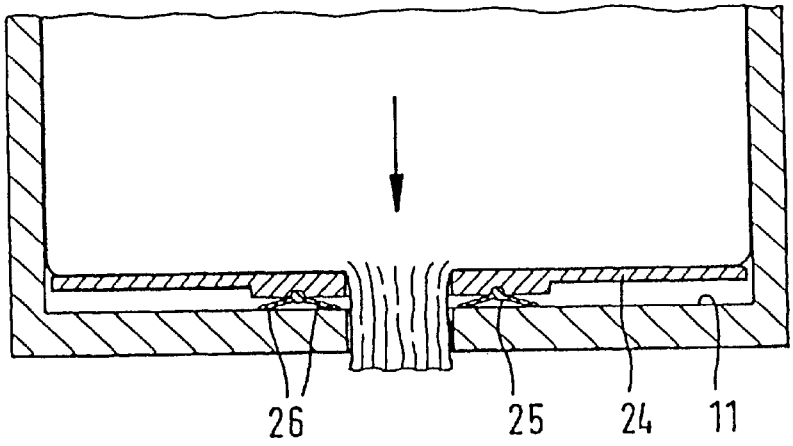

The embodiment according to FIGS. 2 and 3 is distinguished in that at the disk 24, there is disposed a sealing ring 25 which has two resilient sealing lips which are inclined obliquely towards the end face 11 and away from one another. When these sealing lips are pressed against the end face 11 under the action of the plunger pressure, they are deformed in the manner as shown in FIG. 3. In this case, the space enclosed by the lips 26 and the end face 11 is to a large extent emptied. When the plunger pressure ends, the lips form a suction cup which is held firmly at the end face 11 and which prevents the lifting-off of the lips 26 from the end face 11 and thus the movement of breathing and the lack of sealing which would otherwise be associated therewith.

Figure 4:
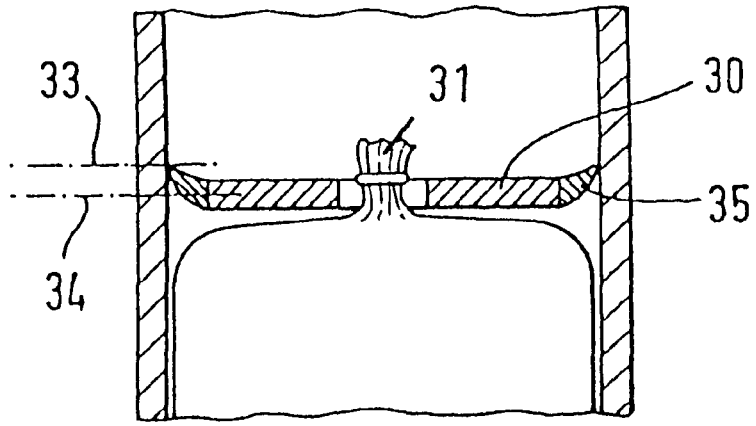
FIGS. 2 and 3 show an exemplary embodiment with a pair of lips designed as a suction holder and FIG. 4 shows an exemplary embodiment with a braking disk arranged on the rear end of the bag.

In FIG. 4, it is assumed that the floor 4 of the cartridge is fixedly connected to its wall 3 and the tubular bag 1 is inserted into the cartridge from the side remote from the expulsion side. However, this does not need to be so.

At the rear end of the tubular bag 1, which faces that end 6 of the cartridge which is remote from the floor, there is fitted onto the tubular bag a disk 30, which includes, at the centre, an opening to receive the closure cord 31 of the bag. Its periphery cooperates in frictional fashion with the inner surface of the cartridge 2. Upon insertion of the tubular bag into the cartridge, the insertion force is transmitted to the bag via the disk 30. Accordingly, the frictional force at the periphery of the disk 30 does not have an effect on the internal pressure of the bag 1. If the cartridge together with the bag contained therein is stored outside the expulsion unit and erected vertically with the rear end downwards, then the frictional force at the periphery of the disk 30 absorbs the weight of the filled bag 1 and holds it in the existing position.

The periphery of the disk 30 can be provided with devices which, even in the case of the existence of certain dimensional tolerances of the disk 30 and of the cartridge 2, maintain the frictional force within a desired range, for example by means of a friction-increasing elastomer ring 32. As shown in FIG. 4, a design can be selected in this case which does indeed set against the rearward movement of the bag a frictional force of desired magnitude, but offers only slight resistance to the insertion of the bag into the cartridge from the rear end of the latter. To this end, the plane 33, in which the line of the contact between the periphery of the disk 30 acting as braking component and the inner surface of the cartridge 2 lies, is rearwardly offset in relation to the main plane 34 of the disk. In the event of axial movement of the disk, the friction generates at its periphery a bending moment, which, in the case of movement directed into the cartridge, urges the contact region radially inwards with reduction of friction and, in the case of the reverse direction of movement, urges it radially outwards with a corresponding increase in friction. In this case, the lip 35 forming the frictional contact can consist of soft material. It may have the represented rearward inclination already in the shaped, relaxed condition; however, it is also possible that the lip lies within the main plane 34 of the disk in the relaxed condition and adopts the inclined position only upon insertion into the cartridge.

The periphery of the disk 30, which periphery abuts against the inner wall of the cartridge 2, does not need to be continuous; rather, it may be interrupted, so that a plurality of flexible arms is formed, the ends of which abut resiliently against the cartridge wall and are connected to one another only in the central region.

The axial offset between the contact plane 33 and the main plane 34 of the disk 30 or of its arms does not need to be predetermined by its original form; rather, the part can also be designed to be flat and may assume the outwardly rearwardly bent form only as a result of resilient deformation upon insertion into the cartridge. In each case, the diameter of the relaxed disk 30 is greater than the internal diameter of the cartridge, so that the disk periphery or the ends of the arms abut against the cartridge wall with a certain pretension.

What is claimed is:

1. Arrangement for squeezing a flowable material out of a tubular bag having an outside diameter and oppositely disposed first and second ends, the first end of the tubular bag defining an opening which is surrounded by a shoulder of the tubular bag, the arrangement comprising:

a squeezing-out unit having oppositely disposed first and second ends and defining a cylindrical space which receives the tubular bag, the first end of the unit having an end face disposed opposite the shoulder of the tubular bag, the end face defining a discharge opening which cooperates with the bag opening, the second end of the unit receiving a pressing plunger; and a sealing ring having at least one sealing component and disk means for connecting the sealing ring to the tubular bag in an angularly movable fashion, the disk means having an annular bead facing the tubular bag, the annular bead having a diameter which is substantially less than the outside diameter of the tubular bag, the disk means being adhesively bonded to the first end of the tubular bag only within the annular bead, the sealing component cooperating with the end face surrounding the discharge opening to seal the discharge opening from the cylindrical space of the unit.

2. Arrangement according to claim 1 wherein the opening of the bag is formed by a gathering of the bag, the gathering penetrating through the sealing ring and lying freely in the discharge opening.

3. Arrangement according to claim 1 wherein the sealing component is yieldable.

4. Arrangement according to claim 1 wherein the sealing component of the sealing ring is formed by at least one annular projection.

5. Arrangement according to claim 1 wherein the external diameter of the sealing ring is slightly smaller than the inside diameter of the cylindrical space to facilitate centering the sealing ring in the squeezing-out unit.

6. Arrangement according to claim 1 wherein the sealing ring is provided with at least one retaining part arresting the sealing ring in the sealing position.

7. Arrangement according to claim 6 wherein the retaining part comprises at least one suction holder cooperating with the end face.

8. Arrangement according to claim 1 wherein the second end of the bag comprises a braking component which frictionally engages the wall of the cylindrical space at least in a direction which resists removal of the bag from the cylindrical space.

9. Arrangement according to claim 8 wherein the braking component comprises a disk or a ring disposed intermediate the pressing plunger and the tubular bag by means of which the pressing plunger acts on the tubular bag.

10. Arrangement according to claim 8 wherein the braking component has a diameter which is greater than the internal diameter of the cylindrical space.

11. Arrangement according to claim 8 wherein a first portion of the braking component engages the wall of the cylindrical space along a circular line of contact, defining a first plane, and a second portion of the braking component abuts against the tubular bag, defining a second plane, wherein the first plane is offset from the second plane in a direction away from the tubular bag.

12. Arrangement according to claim 8 wherein the braking component has an interrupted periphery.

* * * * *